United States Patent [19]

Ramsey et al.

[11] 4,216,694

[45] Aug. 12, 1980

[54] SOLENOID DASHPOT PEDAL ACTUATOR ASSEMBLIES

[75] Inventors: Vernon B. Ramsey; Thomas J. Wilkes, both of Lewisburg, Tenn.

[73] Assignee: Teledyne Industries, Inc., Los Angeles, Calif.

[21] Appl. No.: 943,896

[22] Filed: Sep. 19, 1978

[51] Int. Cl.[2] ..... G10F 3/00

[52] U.S. Cl. ..... 84/23; 16/66; 188/270; 188/282

[58] Field of Search ..... 188/272, 297, 316, 319, 188/317, 282, 270; 84/58, 59, 19–23; 16/66

[56] References Cited

U.S. PATENT DOCUMENTS

| | | | |
|---|---|---|---|
| 753,809 | 3/1904 | Powers et al. | 84/21 |
| 1,165,903 | 12/1915 | Reed | 84/21 |
| 1,184,244 | 5/1916 | Kelly | 84/20 |
| 1,313,877 | 8/1919 | Burnham | 188/272 |
| 2,417,504 | 3/1947 | Knaggs et al. | 188/316 X |
| 2,825,427 | 3/1958 | Steibel | 188/319 X |

*Primary Examiner*—Lawrence R. Franklin
*Attorney, Agent, or Firm*—Jim Zegeer

[57] ABSTRACT

There is disclosed a solenoid-dashpot assembly for actuating the foot pedals of a player piano. A solenoid having an armature shaft extending beyond the coil area of the solenoid receives a piston element, which, in turn, has an O-ring which co-acts with a dashpot cylinder. Constricted air passage elements are formed in the piston element and are provided with relatively large air passages which have mufflers thereon so that no sound is made when air ingresses or egresses through these constricted passages due to actuation and deactuation of the solenoid. To silence both ends of travel of the solenoid armature, the solenoid is mounted above a base plate on a mounting bracket and the solenoid armature carries a pad extending from a side opposite the dashpot. The base plate has an adjustable pad thereon opposite the pad on the solenoid armature so that on actuation and deactuation of the solenoid, there are no noise generating, hard surface to hard surface contacts at either end point of solenoid armature movement. These elements are provided so as to enable the solenoid dashpot assembly to more closely approximate the action of the piano player in the depressing the pedals of the piano, and at the same time, are almost completely silent.

10 Claims, 5 Drawing Figures

SOLENOID DASHPOT PEDAL ACTUATOR ASSEMBLIES

REFERENCE TO RELATED APPLICATIONS

This application is related to U.S. Ser. No. 925,652, entitled "APPARATUS AND METHOD FOR ACTUATING PEDALS OF AN ELECTRONIC PLAYER PIANO" now abandoned; Ser. No. 925,653, entitled "PEDAL ACTUATOR FOR ELECTRONIC PLAYER PIANO"; and, Ser. No. 925,654, entitled "VORSETZER APPARATUS" now abandoned, all applications being filed July 17, 1978.

BACKGROUND OF THE INVENTION

Whenever a piano is being automatically operated in player piano fashion by electronic tape control so as to recreate a musical presentation much in the fashion of a human person playing the piano, the operation of the foot pedals presents a special problem. These units require rather large, robust solenoids but which, at the same time, when they operate must not make any noise which would be a detriment to the musical presentation being created. The solenoid dashpot linkage and assembly disclosed in the above related applications are believed to be the best approach to date of such goal. However, such system utilized pre-existing solenoid-dashpot assemblies which were not specifically adapted to this environment and hence, while avoiding the tromped down, boxy sounding effect of earlier player piano actuators, the present invention is an even greater improvement in reducing the noise and at the same time providing a more positive and realistic sound as if the pedal were actuated by a human foot.

BRIEF DESCRIPTION OF THE DRAWINGS

The above and other objects, advantages and features of the invention will become more apparent from the following specification when considered with the accompanying drawings wherein:

Referring now to FIG. 1, the foot pedal 10 of a conventional piano is pivoted on a fulcrum 11 and has a linkage 12 coupled to the inner end 13 of pedal 10. Linkage 12 is coupled to the piano mechanism for moderating the sound produce by the piano according to the desires of the player. A spring 15 is diagrammatically illustrated as forcing pedal 10 in a counter clockwise or up direction. The foot of the player normally rests on or above pedal 10 and depresses downwardly on pedal 10 so as to rotate it in a counter clockwise direction and urge linkage 12 upwardly. In the player piano disclosed in the above-identified related applications, a special foot 14 (disclosed in detail in the above identified Ramsey application) is connected via. a linkage to the pedal

Figure 1:
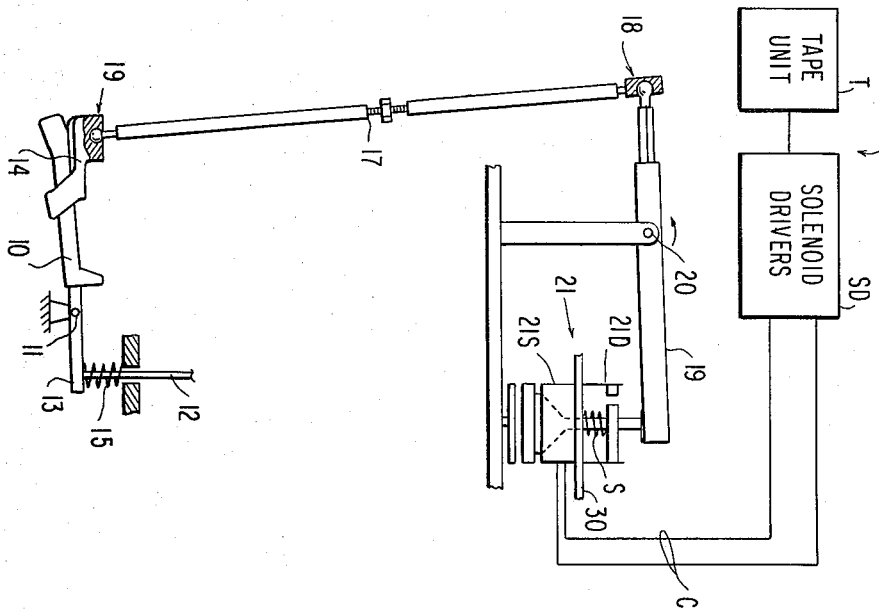
FIG. 1 is a schematic diagram illustrating the pedal linkage system incorporating the invention.

10. This is diagrammatically illustrated in FIG. 1 by the linkage 17. Linkage 17 is coupled via a universal joint 18 to an actuator arm 19, there is also a universal joint 19 coupling foot 14 to actuator linkage 17.

Actuator arm 19 is pivoted on a fulcrum or pivot point 20 and, when actuator arm 19 is rotated in a counter clockwise direction about pivot 20, link 17 is moved downwardly to cause foot 14 to depress downwardly on pedal 10 to thereby actuate the pedal of the piano and therefore moderate the playing of the piano in the usual way.

THE PRESENT INVENTION

In order to operate actuator arm 19 about pivot 20, a solenoid-dashpot assembly 21 is provided which includes a dashpot 21D and a solenoid 21S which receives energizing signals from a signal source 22. Signal source 22, in the preferred embodiment, includes a magnetic tape cassette player assembly T supplying signals to solenoid driver SD, which are connected by conductors C to the solenoids 21S, there being a solenoid driver for each solenoid. In such a tape cassette player assembly, the signals on the tape are decoded to provide operating signals for the solenoids 21S.

As disclosed in the above-identified related applications, the solenoid, dashpot and spring mechanism for operating the actuator arm 19 have a spring S serving to maintain the linkage system in a balanced state, that is, the force acting downwardly on link 17 by spring S in the actuator and the weight of the component parts are just sufficient to maintain the linkage in condition such that there are no lost motions at any joint or connection to thereby enhance the performance (recreation of the musical presentation) and assure silent linkage operation.

Figure 2:
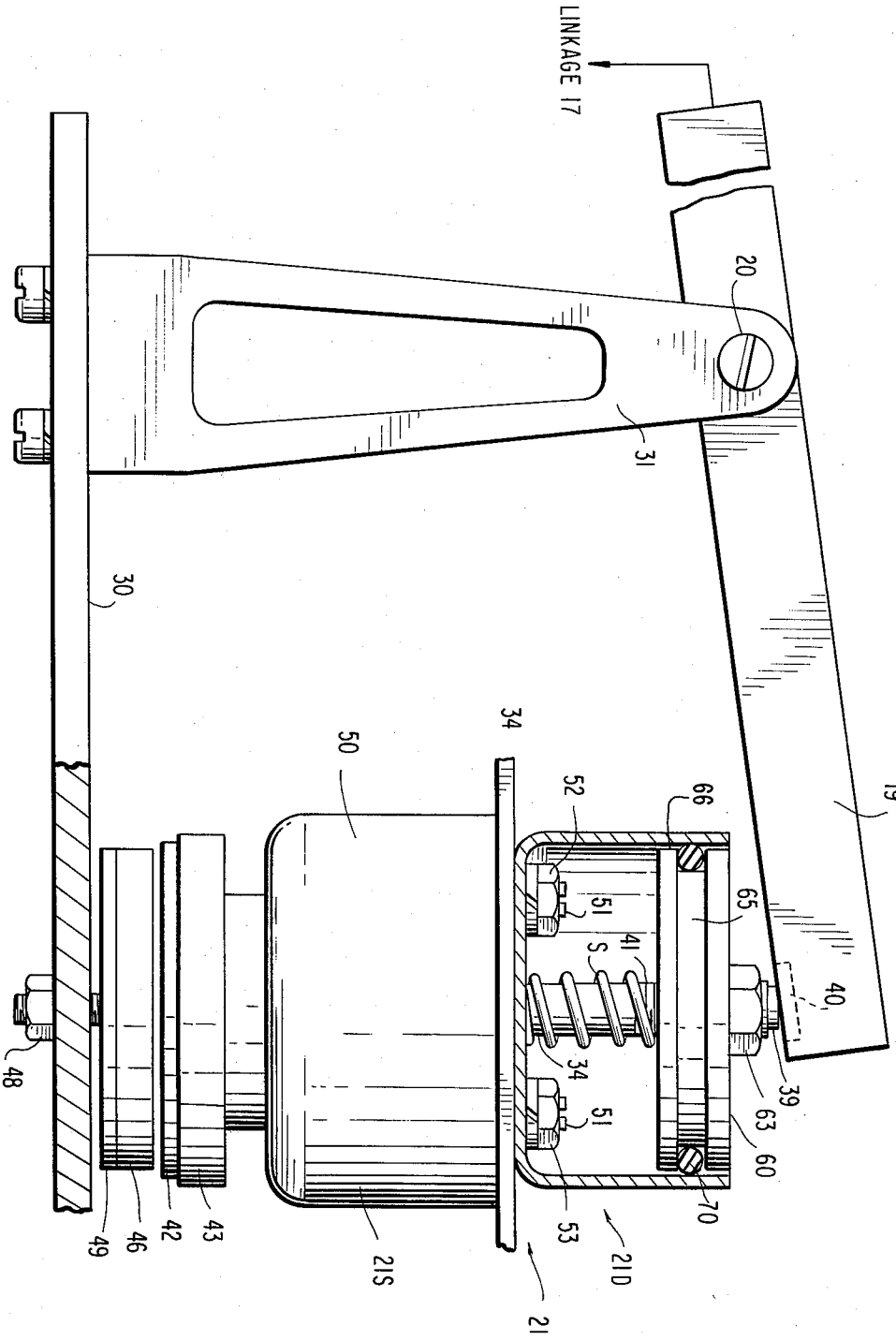
FIG. 2 is a side, partial cross-sectional, view of a solenoid-dashpot actuator assembly incorporating the invention.

Referring now to FIG. 2, the solenoid-dashpot actuator assembly of the present invention is shown as including a metal base plate 30 supporting a fulcrum 31 having pivot 20 thereon for actuator arm 19. The pivot 20 includes nylon bearings or bushings 21 (see FIG. 4). Fulcrum 31 is bolted to the base plate 30, there being a series of holes (not shown) for adjusting the position of fulcrum 31 to permit adaptation to pianos of various manufactures. In addition, a series of holes (not shown) is provided in actuator arm 19 for receiving the pivot and the nylon bearings discussed earlier.

As shown in FIG. 2, the solenoid-dashpot assembly is in the actuating state with the actuator arm 19 having been rotated in a counter clockwise direction.

Figure 3:
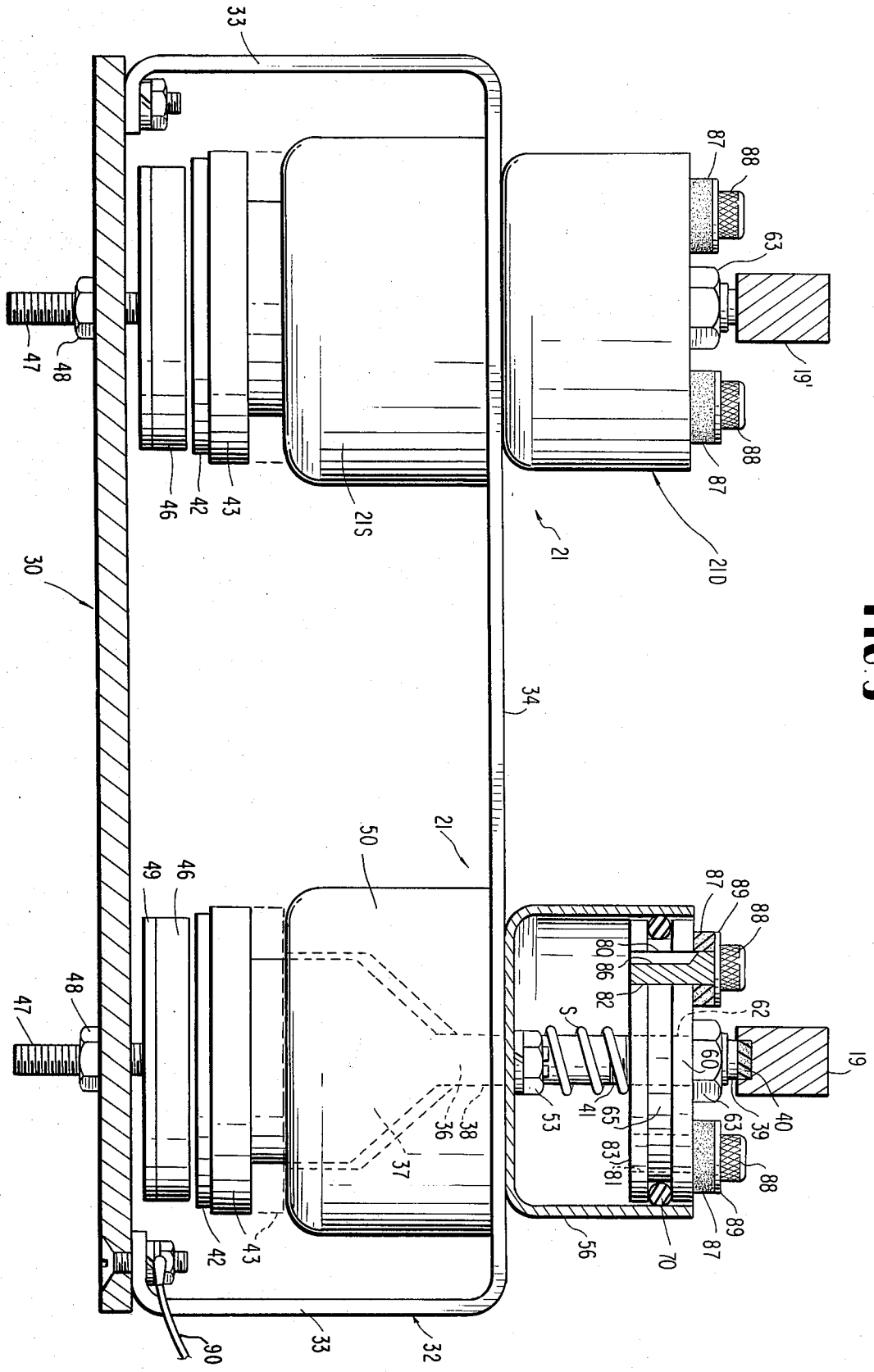
FIG. 3 is an end view from he right-hand of FIG. 2 also in partial showing section the dash-pot of the solenoid-dashpot assembly.

The present invention is concerned primarily with the construction of the solenoid-dashpot assembly 21. As shown in FIGS. 2 and 3, a U-shaped bracket 32 having a pair of depending legs 33 bolted to base plate 30 has bolted thereto a pair of solenoid-dashpot actuators, one for the soft pedal of the piano and one for the sustain pedal. There can, of course, be a further solenoid to actuate the third or bass pedal of the piano if desired. Mounting bracket 32 has a cross arm 34 connecting legs 33 and it is on cross arm 34 that the solenoid-dashpot are actually mounted. The solenoid-dashpot assembly 21 include a solenoid 21S and a dashpot 21D. According to the invention, the solenoid 21S is of a short stroke type which is commercially available and has a relatively large armature 36. Armature 36 has a conical portion 37 and a shank portion 38, the end 39 of which engages a neoprene insert 40 in the underside of actuator arm 19. The shank portion 38 of solenoid armature 36 is threaded as indicated at 41. A flat metal washer 42 is secured to the lower end of armature 36 and a pad 43 is seated on the washer so that on the inward or actuation stroke of the solenoid the solenoid does not fully bottom out so that there is no metal to metal clacking. In addition, on the deactuation stroke, when the spring 14 of the piano action is urging the linkage 17 in an upward direction which urges actuator arm 19 in a clockwise direction (which is at the same time opposed or balanced to a certain degree by spring S), the weight of the solenoid and the deactuation stroke causes it to move downward and, to avoid any metal to metal contact producing a clacking or metallic sound, a further pad 46 is mounted on a threaded shaft 47 and held in position by a lock nut 48 so as to cushion or shock absorb the movement of the armature 36 of the solenoid 21S. The cushioning or shock absorbing of the movement of the solenoid at both ends of its stroke for silencing purposes is well known in the art and need not be further discussed herein. Pad 46 is supported on threaded shaft 47 by a washer plate 49.

The solenoid housing 50 is provided with a pair of bolts 51 which project through the leg 34 of the mounting bracket 30 and is secured therein with the threaded portion 41 of solenoid armature 38 projecting therethrough. A dashpot cylinder 56 which is of lightweight stamped metal and having smooth interior walls is secured in aligned relation with the solenoid 21S and is secured in position by threaded bolts 51 projecting from the solenoid 21S through aligned holes in mounting bracket 30. A pair of nuts and lock washers 52, 53 secures this assembly in rigid relation. Spring S is placed over the extended shaft 38 of the solenoid and, as described earlier herein, the spring acts in opposition to the action of spring 15 of the piano action. As disclosed in the above-identified applications, spring 15 is merely diagrammatically illustrated in the position shown, it could be any other place in the piano action. It is, however, a feature of the present invention that spring S is included in the solenoid-dashpot assembly.

The lower end of spring S bears against the bottom of dashpot cylinder 56 and the upper end bears on the underside of the dashpot piston 60. Dashpot piston 60 has a threaded bore 62 which is threadably engaged with the threads 41 on armature 34 and hence moves therewith. The position of dashpot piston 60 can be adjusted along the threaded shaft 41 and is locked in position by a lock nut 63. Dashpot piston 60 can be of metal or plastic as can be the dashpot cylinder 56. However, in the disclosed embodiment, the dashpot cylinder is of an aluminum stamping and the dashpot piston is of aluminum. An annular groove 65 is formed in peripheral edge 66 of dashpot piston 60. An annular O-ring 70 is received in peripheral groove or slot 65. This O-ring is selected to be just a few thousands of an inch larger than the inside diameter of dashpot cylinder 56 and it completely floats in groove 65 so that if the piston 60 moves slightly to one side or the other it doesn't force the O-ring hard against that side; the O-ring just slips inside the groove 65 and its diameter is smaller than the worst case centering of piston 60 in dashpot cylinder 56. What is sought to be avoided is any metal to metal contact and, more importantly, the avoidance of the piston to ever change the side loads between the O-ring and the piston wall. In other words, the objective is to achieve a low coefficient of friction so as to not reduce the force of the solenoid and just reduce or moderate the velocity. As indicated above, the O-ring 70 floats inside groove 65. The groove in the piston is slightly larger than the diameter of the O-ring so that it has a very little slop thereby to avoid any binding. The O-ring floats in the groove so that if the piston moves slightly off center it can't cause the O-ring to press harder against the wall of cylinder 56. The piston diameter is about 60,000th to 80,000th of an inch smaller than dashpot cylinder 56.

The O-ring 70 is of high quality industrial grade O-ring material and at the time of assembly of the piston, O-ring and dashpot cylinder 56 a small amount of dry graphite is applied to the assembly and worked into the aluminum walls of the piston to increase the smoothness and lubricity of the surface after a little bit of operation.

Figure 5:
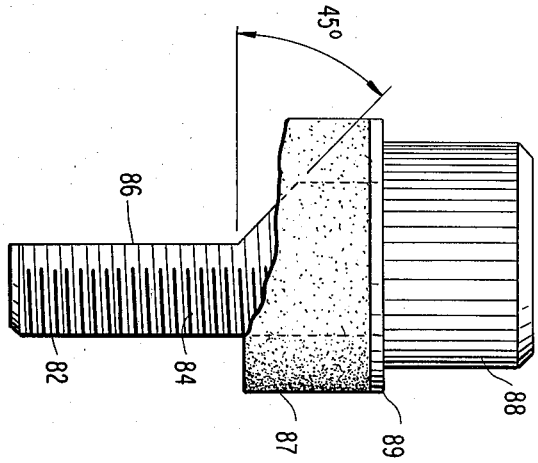
FIG. 5 illustrates the needle valve and felt assembly for moderating the flow of fluid to and from the dashpot cylinder.

A pair of constrictions 80, 81 are provided in piston 60. These passages 80 and 81 are threaded and received a needle valve element 82 and 83, respectively. As shown in FIG. 5, each needle valve element 82 and 83 has a threaded shaft 84 which has one flat side 86. A large felt pad 87 is provided concentric with the threaded shaft 82 of the needle valve and a knurled thumb adjustment 88 is formed on the upper end of the needle valve 82. An enlarged flange or shoulder 89 also formed beneath the knurlations 88 to compress and assure uniformity in the action of the felt pads 87 in muffling the sound of air rushing through the portions of apertures 80 and 81 left open by the cut-off portion or flat 86 of needle valve 82. Pads 87 are felt material and significantly muffle the sound of rushing air without affecting the dashpot action desired. Two constricted apertures are provided in the preferred embodiment but, with larger dashpot assemblies, or smaller dashpot assemblies, more or less constricted apertures may be provided, the basic objective of the pads being to muffle the sound of air rushing through the constricted passages.

Figure 4:
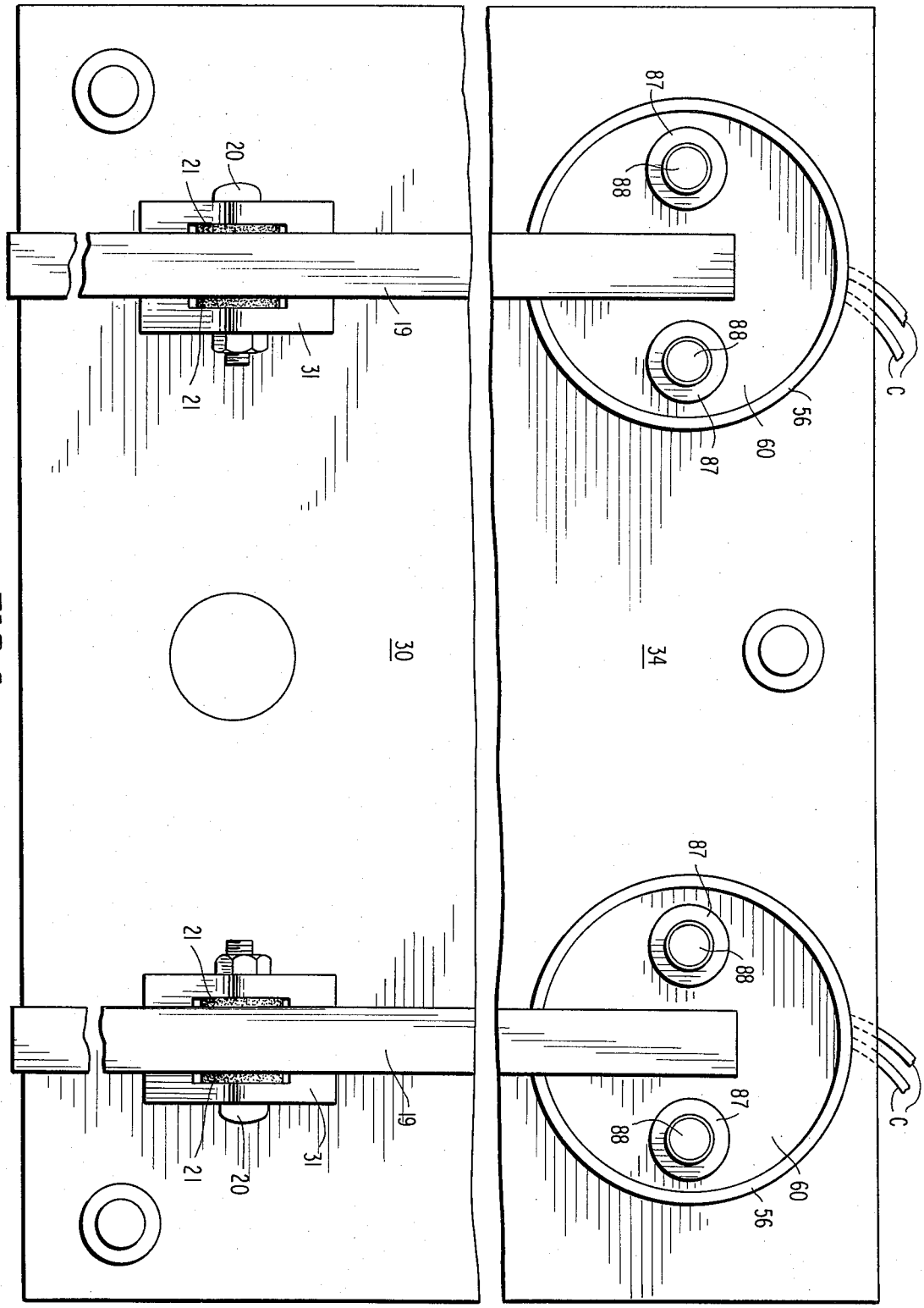
FIG. 4 is a top plan view of FIG. 3 showing the solenoid-dashpot actuator incorporating the invention.

As illustrated in FIGS. 3 and 4, a pair of solenoid-dashpot assemblies 21 are mounted on the bracket 30. A ground wire 90 commonly connect the solenoid assemblies and all metal parts to electrical ground, not shown.

The dashpot thus linearizes the solenoid. The dashpot action is a double action that is, the air rushes into the dashpot cylinder on actuation of the solenoid via the constricted passages and rushes out of the dash cylinder via the constricted passages upon deactuation of the solenoid. The dashpot orifices are adjustable by virtue of the tapered needle valve elements 82 and 83. In FIG. 3, the solenoids are shown as partially energized but the dashpot piston is shown in a fully actuated state—solely for purposes of exposition of the invention. That is to say, the pad 43 at the bottom of solenoid armature 36 is, in actuality, in an engagement with the housing 50 of the solenoid and prevents the cone of the armature from engaging the internal cone of the solenoid to thereby avoid the metallic sound.

While a preferred embodiment of the invention has been disclosed herein, it will be appreciated that other embodiments and modifications of the invention will be suggested to those skilled in the art and it is intended that such modifications be encompassed by the following claims:

What is claimed is:

1. In a piano pedal actuator assembly having a solenoid-dashpot assembly for operating one or more foot pedals upon energization of the solenoid, improvement in the dashpot assembly of said solenoid to enable said actuator assembly to more closely approximate the action of the pianist in the depressing of the pedals of the piano and substantially reduce extraneous noise, which comprises:

a dashpot cylinder, a piston coupled to the armature of said solenoid and moving in said dashpot cylinder, said dashpot piston being smaller in diameter than the internal diameter of said dashpot cylinder, an O-ring floating adjacent the periphery of said dashpot piston and engaging the walls of said dashpot cylinder, and means maintaining said O-ring at said periphery of said dashpot piston, and at least one constricted orifice in communication with the interior cylinder space enclosed by said dashpot cylinder and said dashpot piston and through which air substantially silently egresses and ingresses to the ambient space.

2. The invention defined in claim 1 wherein said constricted orifice includes means for muffling the sound of air egressing and ingressing from said dashpot cylinder.

3. The invention defined in claim 2 wherein said constricted orifice is formed in said dashpot piston.

4. The invention defined in claim 3 wherein there are a plurality of said constricted orifices each of which includes means for muffling the sound of air ingressing and egressing from said dashpot.

5. The invention defined in claim 2 wherein said means for muffling the sound of air is a felt pad across said constricted passage.

6. The invention defined in claim 5 wherein said constricted passage is a threaded bore in said dashpot piston, a needle valve threadably engaged in said bore and said felt pad is concentric with said needle valve.

7. The invention defined in claim 6 wherein said needle valve include a flange member engaging said felt pad to variably compress same according to the size of said constriction as determined by said needle valve.

8. The invention defined in claim 1 including a spring between the base of said dashpot cylinder and said dashpot piston urging said dashpot piston out of said dashpot cylinder.

9. The invention defined in claim 1 wherein said dashpot cylinder and said solenoid are co-axial and the armature of said solenoid has a threaded shaft extending through said dashpot cylinder, and including means for adjustably securing said dashpot piston on said solenoid shaft.

10. The invention defined in claim 9 wherein said means for adjustably securing includes a threaded bore on said dashpot piston which is threadably engaged with said threaded shaft on said armature of said solenoid.

* * * * *